US007789243B2

(12) United States Patent
Hornung et al.

(10) Patent No.: US 7,789,243 B2
(45) Date of Patent: Sep. 7, 2010

(54) METHOD FOR ADJUSTING A BANK NOTE PROCESSING MACHINE

(75) Inventors: Heinz Hornung, Gilching (DE); Wilhelm Breit Sameter, Freising (DE); Joerg Breisch, Munich (DE)

(73) Assignee: Giesecke & Devrient, GmbH, Munich (DE)

( * ) Notice: Subject to any disclaimer, the term of this patent is extended or adjusted under 35 U.S.C. 154(b) by 784 days.

(21) Appl. No.: 10/520,076

(22) PCT Filed: Jul. 10, 2003

(86) PCT No.: PCT/EP03/07497

§ 371 (c)(1),
(2), (4) Date: Jul. 27, 2005

(87) PCT Pub. No.: WO2004/008398

PCT Pub. Date: Jan. 22, 2004

(65) Prior Publication Data

US 2006/0011447 A1 Jan. 19, 2006

(30) Foreign Application Priority Data

Jul. 11, 2002 (DE) ..... 102 31 409

(51) Int. Cl.
*G07F 7/04* (2006.01)
*B07C 5/00* (2006.01)

(52) U.S. Cl. ..... 209/534; 194/206

(58) Field of Classification Search ..... 209/534; 194/206, 207, 302; 377/8
See application file for complete search history.

(56) References Cited

U.S. PATENT DOCUMENTS

| | | | | |
|---|---|---|---|---|
| 4,500,002 | A | 2/1985 | Koshio et al. | |
| 5,462,149 | A * | 10/1995 | Waine et al. | 194/206 |
| 5,680,472 | A * | 10/1997 | Conant | 382/135 |
| 6,012,565 | A | 1/2000 | Mazur | |
| 6,061,121 | A * | 5/2000 | Holl et al. | 356/71 |
| 6,125,987 | A * | 10/2000 | Abe et al. | 194/213 |
| 6,913,260 | B2 * | 7/2005 | Maier et al. | 271/265.04 |
| 7,044,463 | B2 * | 5/2006 | Brotherston et al. | 270/52.02 |
| 2002/0056605 | A1 * | 5/2002 | Mazur et al. | 194/207 |

FOREIGN PATENT DOCUMENTS

| | | | |
|---|---|---|---|
| DE | 31 39 447 A1 | | 6/1982 |
| DE | 32 47 267 A1 | | 7/1983 |
| EP | 0 779 604 | | 6/1997 |
| GB | 2 088 832 | | 6/1982 |
| WO | WO 00/48138 | * | 8/2000 |

* cited by examiner

*Primary Examiner*—Joseph C Rodriguez
(74) *Attorney, Agent, or Firm*—Rothwell, Figg, Ernst & Manbeck, P.C.

(57) ABSTRACT

In a bank note processing machine, a method of adjusting the threshold values associated with whether a particular note is fit or unfit for circulation is provided. The starting point is that at least one bank note fit for circulation is selected, at least one bank note unfit for circulation is selected, and the selected bank notes are processed by the bank note processing machine. The data of at least one sensor are stored, and at least one threshold value for the at least one sensor is defined by evaluating the stored data of the at least one sensor.

7 Claims, 1 Drawing Sheet

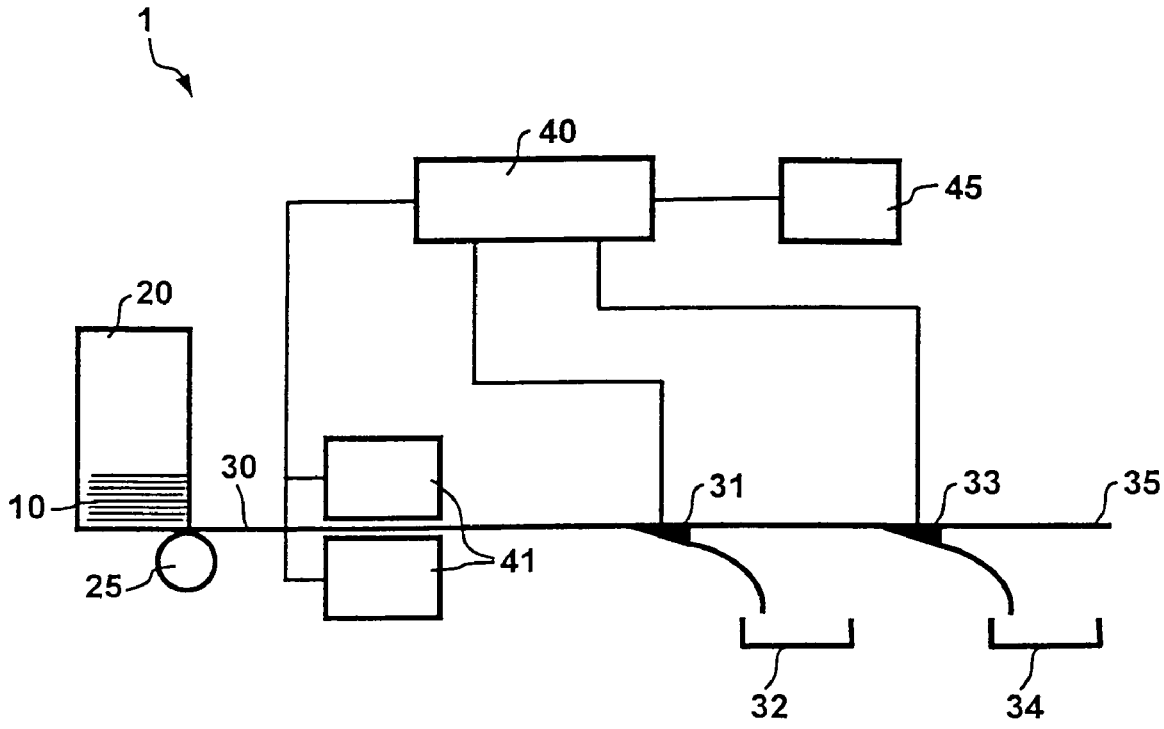
Fig.

METHOD FOR ADJUSTING A BANK NOTE PROCESSING MACHINE

CROSS-REFERENCE TO RELATED APPLICATION

This application is a National Phase of International Application Serial No. PCT/EP03/07497, filed Jul. 10, 2003.

FIELD OF THE INVENTION

This invention relates to a method for adjusting a bank note processing machine wherein threshold values of sensors are defined for recognizing bank notes unfit for circulation.

DESCRIPTION OF THE BACKGROUND ART

Known methods for adjusting bank note processing machines wherein threshold values of sensors are defined for recognizing bank notes unfit for circulation require an operator to select and define suitable threshold values for the sensors. The threshold values defined by the operator then serve to separate the bank notes to be processed into bank notes fit for circulation and those unfit for circulation by means of the bank note processing machine, for which purpose the bank notes are sorted by the bank note processing machine into different output pockets for example.

The disadvantage of known methods is primarily that it is very complicated and laborious for the operator to define suitable threshold values for the sensors of the bank note processing machine. He starts out for example from threshold values already given by the manufacturer of the bank note processing machine, which are firmly set. Problems arise e.g. from aging or soiling of the bank note processing machine or from changes in the bank notes to be processed. If one or more of the threshold values are defined only slightly too high by the operator, bank notes that are actually no longer fit for circulation are classified by the bank note processing machine as fit for circulation. However, if one or more of the threshold values are defined only slightly too low by the operator, bank notes that are actually fit for circulation are classified by the bank note processing machine as no longer fit for circulation. Thus the bank notes to be processed are not separated into bank notes fit for circulation and those unfit for circulation in the way desired by the operator.

SUMMARY OF THE INVENTION

The problem of the present invention is therefore to specify a method for adjusting a bank note processing machine wherein threshold values of sensors are defined for recognizing bank notes unfit for circulation without an operator having to intervene or without an operator having to select or define the thresholds.

This problem is solved by the features stated herein.

In a method for adjusting a bank note processing machine wherein threshold values of sensors are defined for recognizing bank notes unfit for circulation, the starting point is that at least one bank note fit for circulation is selected, at least one bank note unfit for circulation is selected, the selected bank notes are processed by means of the bank note processing machine, whereby data of at least one sensor are stored, and at least one threshold value for the at least one sensor is defined by evaluating the stored data of the at least one sensor.

The advantage of the invention is to be seen in particular in that an operator of the bank note processing machine can change the threshold values of the sensors any time without any complicated adjusting operations by providing a selection of bank notes fit for circulation and those unfit for circulation. The selection of bank notes fit for circulation and those unfit for circulation is processed in a special processing mode by the bank note processing machine and the threshold value or values are defined automatically by the bank note processing machine or its control device in accordance with the bank note properties given by the selection of bank notes fit for circulation and those unfit for circulation. Since the selection of bank notes fit for circulation and those unfit for circulation is processed by the bank note processing machine in the way known to the operator from all other processing operations or processing modes, an extremely simple method for defining the threshold values is provided which is carried out without any intervention or control by the operator.

Further advantages of the present invention can be found in the dependent claims and the following description of an embodiment with reference to a FIGURE.

BRIEF DESCRIPTION OF THE DRAWING

The single FIGURE shows the schematic structure of a bank note processing machine for carrying out a method for adjusting a bank note processing machine wherein threshold values of sensors are defined for recognizing bank notes unfit for circulation.

DETAILED DESCRIPTION OF THE INVENTION

The FIGURE shows a bank note processing machine 1 having an input pocket 20 into which bank notes 10 to be processed can be inserted, i.e. bank notes that are to be separated into bank notes fit for circulation and those unfit for circulation. The bank notes 10 are grasped by a singler 25 singly, one after the other, and transferred to a transport system 30. The transport system 30 transports the single bank notes through a measuring device 41.

The measuring device 41 contains at least one sensor whose signal provides an indication of the state of the particular bank note to permit a judgment and classification of the bank note as fit for circulation or unfit for circulation. The sensor or sensors of the measuring device 41 may be for example optical sensors as well as suitable light sources, the sensors detecting light reflected by the particular bank note or transmitted through the particular bank note, e.g. light of a certain wavelength or wavelength range. Further sensors can evaluate for example acoustic and/or mechanical and/or thermal and/or magnetic and/or electrical properties of the particular bank note. The stated sensors permit e.g. statements on whether the particular bank note is soiled or damaged or whether it has alien elements such as clips or adhesive tape which affect the fitness for circulation of the particular bank note.

Using the signals provided by the measuring device 41, a control device 40, which can be formed e.g. by a microprocessor with an associated memory, determines whether the particular bank note is a bank note fit for circulation or one unfit for circulation. For this purpose the control device 40 compares the signals provided by the measuring device 41 with given threshold values which are stored e.g. in the memory of the control device 40.

In dependence on the state of the bank note as ascertained by the control device 40, the control device 40 drives diverters 31 and 33 in the transport system 30 for depositing bank notes fit for circulation in a first output pocket 32 and bank notes unfit for circulation in a second output pocket 34 for example. Further diverters or output pockets can be provided in the transport system 30 of the bank note processing machine 1 and are indicated by a continuing line 35.

An input/output device 45 connected to the control device 40 and consisting e.g. of a keyboard and a display is used for operation of the bank note processing machine 1 by an operator. The keyboard can be used for entering commands or selecting processing modes, and the display can indicate processing results or instructions asking the operator to perform certain actions.

For adjusting or selecting one or more threshold values for bank notes unfit for circulation, the operator selects any desired quantity of bank notes which he classifies as unfit for circulation, i.e. these bank notes have striking features such as soiling, damage, clips, adhesive tape, etc. In the same way, the operator selects any desired quantity of bank notes which he classifies as fit for circulation, i.e. these bank notes have e.g. at most slight soiling and/or damage which is not felt to be disturbing.

Using the input/output device 45, the operator selects an operating mode of the bank note processing machine 1 in which the one or more threshold values can be defined for determining fitness for circulation.

Under the control of the control device 40 the operator is then for example asked by the input/output device 45 to first insert those bank notes into the input pocket 20 that he has classified as unfit for circulation. The bank notes classified as unfit for circulation are grasped singly by the singler 25 and transferred to the transport system 30. The measuring device 41, or the sensor or sensors contained therein, determine signals representative of the particular bank note which are transmitted to the control device 40. The data of the signals of the measuring device 41 can be stored in the memory of the control device 40 in unchanged form. It is likewise possible that the signals of the measuring device 41 are processed by the control device 40, the data of the result obtained during processing being stored. The processed bank notes are transported by the transport system 30 under the control of the control unit 40 into the second output pocket 34 for example.

After all bank notes classified as unfit for circulation have been processed, the operator is asked by means of the input/output device 45 to insert the bank notes classified as fit for circulation into the input pocket 20. The bank notes fit for circulation are processed in the way described above for bank notes unfit for circulation, the data obtained during processing likewise being stored in the memory of the control device 40 and the processed bank notes deposited e.g. in the first output pocket 32.

On the basis of the stored data of the bank notes fit for circulation and those unfit for circulation, the control device 40 determines one or more threshold values for the sensor or sensors of the measuring device 41, the threshold values being so defined that the bank notes classified as unfit for circulation by the operator are also judged as unfit for circulation by the bank note processing machine 1. Accordingly the bank notes classified as fit for circulation by the operator are also judged as fit for circulation by the bank note processing machine 1.

During definition of the threshold value or values by the control device 40 it may be provided that the control device 40 determines the threshold value or values from the stored data and stores them in its memory for later use. However, it can also be provided that a multitude of threshold values was previously determined and stored in the memory, e.g. during production of the bank note processing machine 1. In this case the control device 40 selects the existing threshold value or values that best correspond to the stored data.

After the threshold value or values have been determined or selected, the data stored in the memory of the control device 40 can be deleted. During later processing of bank notes, i.e. during separation of bank notes into bank notes unfit for circulation and those fit for circulation, the bank note processing machine 1 then uses the threshold value or values stored in the memory of the control device 40 or selected.

To guarantee reliable separation of bank notes fit for circulation and those unfit for circulation, separate threshold values must be determined or selected for each kind of bank note, since each kind of bank note has its own physical properties which as a rule differ greatly from bank notes of another kind. This means that the above-described determination or selection of threshold values by means of bank notes classified as unfit for circulation and ones classified as fit for circulation must be carried out for each denomination of each currency to be processed with the bank note processing machine 1. Accordingly, in later processing of bank notes the kind of bank note to be processed is first defined by the operator or determined by the bank note processing machine 1 to permit the associated threshold value or values to be carried out for separating the bank notes to be processed into bank notes fit for circulation and those unfit for circulation.

Besides the above-described insertion of bank notes unfit for circulation and those fit for circulation in succession, the bank notes unfit for circulation and those fit for circulation can also be inserted into the input pocket 20 together in the operating mode for defining the threshold value or values if they can clearly be separated from each other by the bank note processing machine 1. This can be obtained for example by means of a separation card which is inserted between the bank notes unfit for circulation and those fit for circulation. During processing, the separation card is recognized by the control device 40 on the basis of the signals of the measuring device 41, so that the separation between bank notes unfit for circulation and those fit for circulation can be carried out by the control device 40.

Besides the above-mentioned order for determining or selecting threshold values by which bank notes unfit for circulation are first inserted and then those fit for circulation, the reverse order can of course also be used.

It is likewise possible to provide joint insertion of the quantity of all selected bank notes instead of the described separate insertion of bank notes classified as unfit for circulation and those classified as fit for circulation. In this case it can be provided that the operator uses the input/output device 45 to specify a rate for the bank notes classified as unfit for circulation, e.g. in percent. If for example 10% of the bank notes are classified as unfit for circulation by the operator, this value is entered by the operator. In the above-described way the data stored in the memory of the control device 40 for all selected bank notes are analyzed by the control device 40, how great e.g. the soiling and/or damage, etc., of the individual bank notes is. On the basis of this analysis the data of the 10% of the selected bank notes are used for determining or selecting the threshold value or values which have the greatest soiling and/or damage, etc.

The above-described quantity of selected bank notes must comprise at least one bank note unfit for circulation and at least one fit for circulation. However, better results in determining or selecting the threshold values for separating bank notes into bank notes fit for circulation and those unfit for circulation are achieved if a larger number of bank notes fit for circulation and those unfit for circulation is in each case selected and processed by the bank note processing machine 1 in the operating mode for defining the threshold value or values.

Further, it is possible to make further distinctions that depend on the state of the bank notes, besides the described distinction of bank notes fit for circulation and those unfit for circulation. For example, additional threshold values can be defined for bank notes that are suitable for use in an automatic cash dispenser. Such bank notes must as a rule meet higher demands with regard to their state than bank notes fit for circulation in general.

Also, the term "threshold value" is not only intended to refer to a value firmly given for one or more of the sensors of the measuring device 41. Rather, functions, interpolations, approximations, etc., can also be provided which describe a discriminant function permitting the bank notes under examination to be separated in the desired way.

The invention claimed is:

1. A method for adjusting a bank note processing machine wherein threshold values of sensors are defined for recognizing bank notes unfit for circulation, comprising:

selecting at least one bank note fit for circulation, wherein the selection of the fit bank note is based at least in part on the lack of soil, damage, or alien elements;

selecting at least one bank note unfit for circulation, wherein the selection of the unfit bank note is based at least in part on the presence of soil, damage, or alien elements;

processing the selected bank notes by means of the bank note processing machine, whereby data of at least one sensor are stored; and defining at least one threshold value for the at least one sensor by evaluating the stored data of the at least one sensor;

wherein bank notes fit for circulation and those unfit for circulation are processed jointly and at least one of the rate of the bank notes fit for circulation or the rate of those unfit for circulation is specified.

2. The method according to claim 1, further comprising a bank note processing machine for carrying out the method according to claim 1.

3. A method according to claim 1, wherein the definition of the at least one threshold value is effected by determining the threshold value.

4. A method according to claim 1, wherein the method is carried out for each kind of bank notes.

5. A method according to claim 1, wherein at least one further threshold value is defined for at least one of bank notes fit for circulation or those unfit for circulation.

6. A method according to claim 5, wherein the at least one further threshold value is defined for bank notes that are suitable for automatic cash dispensers.

7. A method according to claim 1, wherein the at least one threshold value is formed by a discriminant function.

* * * * *